US010221568B2

(12) United States Patent
Ljubicic Rubio

(10) Patent No.: US 10,221,568 B2
(45) Date of Patent: Mar. 5, 2019

(54) INTEGRAL ARQUITECTURAL MODULAR HOUSE ASSEMBLY AND FABRICATION SYSTEM WITH INTERCONNECTING UNIVERSAL WALLS AND UNIVERSAL CONNECTORS AND UNIVERSAL ROOF PIECES

(71) Applicant: Juan Fernando Ljubicic Rubio, Lima (PE)

(72) Inventor: Juan Fernando Ljubicic Rubio, Lima (PE)

( * ) Notice: Subject to any disclaimer, the term of this patent is extended or adjusted under 35 U.S.C. 154(b) by 0 days.

(21) Appl. No.: 15/024,741

(22) PCT Filed: May 21, 2014

(86) PCT No.: PCT/PE2014/000007
§ 371 (c)(1),
(2) Date: Mar. 24, 2016

(87) PCT Pub. No.: WO2015/194972
PCT Pub. Date: Dec. 23, 2015

(65) Prior Publication Data

US 2016/0305123 A1 Oct. 20, 2016

(30) Foreign Application Priority Data

May 21, 2013 (PE) ..... 001233-2013/DIN

(51) Int. Cl.

| | |
|---|---|
| ***E04C 2/52*** | (2006.01) |
| ***E04H 1/12*** | (2006.01) |
| ***E04B 1/343*** | (2006.01) |
| ***E04B 2/00*** | (2006.01) |
| ***E04B 5/02*** | (2006.01) |

(Continued)

(52) U.S. Cl.
CPC ..... *E04C 2/521* (2013.01); *E04B 1/02* (2013.01); *E04B 1/34321* (2013.01); *E04B 2/7453* (2013.01); *E04B 7/22* (2013.01); *E04C 2/46* (2013.01); *E04C 2/50* (2013.01); *E04C 2/526* (2013.01); *E04H 1/005* (2013.01); *E04H 1/12* (2013.01); *H01R 24/66* (2013.01);
(Continued)

(58) Field of Classification Search
CPC . E04C 2/521; E04C 2/46; E04C 2/526; E04C 2/50; E04H 1/005; H01R 24/66; H01R 24/76; H01R 2103/00; E04B 1/34321
USPC ..... 52/220.2, 220.1, 220.8
See application file for complete search history.

(56) References Cited

U.S. PATENT DOCUMENTS 2,034,215 A * 3/1936 Stencel ..... E04B 1/0023 52/206
3,694,973 A * 10/1972 Unger ..... E04C 2/521 52/125.4

(Continued)

*Primary Examiner* — Basil S Katcheves
(74) *Attorney, Agent, or Firm* — Defillo & Associates; Evelyn A DeFillo

(57) ABSTRACT

A modular construction system based on interconnected universal parts including at least one wall having an electrical wiring circuit built-in into the top end of the wall, electrical lateral connection links built-in into the wall, wall-ceiling electrical connection links built-in into the wall, a water pipeline circuit built-in into the wall, and corresponding fixed lateral water connection links; at least one connector to connect adjacent walls; and at least one roof piece made up of at least one inner side containing the electrical wiring network.

7 Claims, 24 Drawing Sheets

Figure 1:
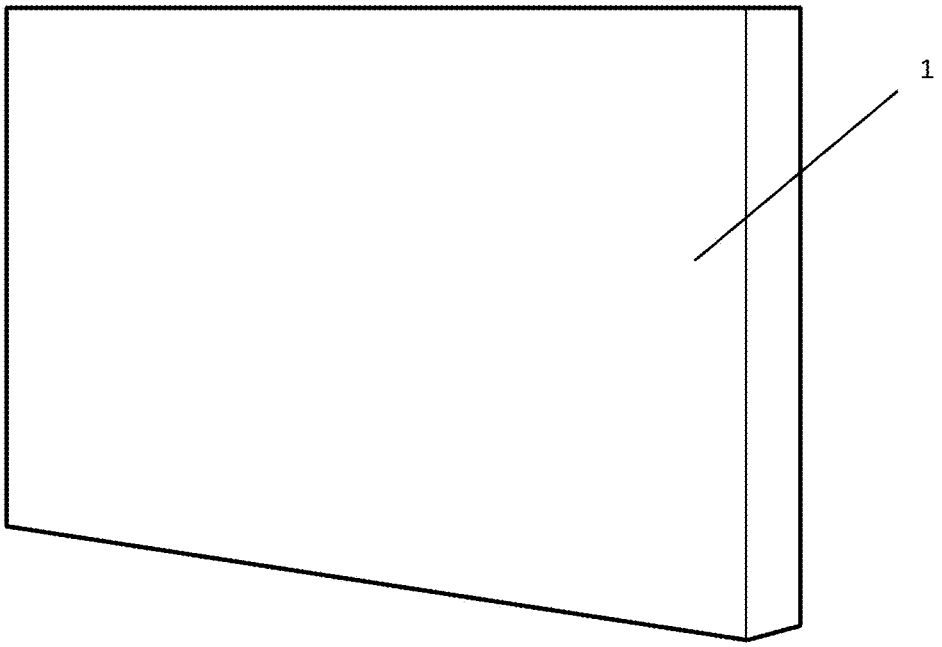

(51) Int. Cl.

| | |
|---|---|
| ***E04H 1/00*** | (2006.01) |
| ***H01R 24/66*** | (2011.01) |
| ***H01R 24/76*** | (2011.01) |
| ***E04B 7/22*** | (2006.01) |
| ***E04B 1/02*** | (2006.01) |
| ***E04B 2/74*** | (2006.01) |
| *H01R 103/00* | (2006.01) |

(52) U.S. Cl.
CPC ..... *H01R 24/76* (2013.01); *E04B 2002/7488* (2013.01); *H01R 2103/00* (2013.01)

(56) References Cited

U.S. PATENT DOCUMENTS

| | | | | | |
|---|---|---|---|---|---|
| 3,707,165 | A * | 12/1972 | Stahl | E04C 2/521 | 137/375 |
| 4,862,660 | A * | 9/1989 | Raymond | F24F 13/20 | 52/220.2 |
| 5,519,971 | A * | 5/1996 | Ramirez | E04C 2/52 | 52/220.2 |
| 6,164,035 | A * | 12/2000 | Roberts | E04B 1/14 | 52/220.2 |
| 8,272,182 | B1 * | 9/2012 | Spiegel | E04B 1/24 | 52/404.2 |
| 2005/0188632 | A1 * | 9/2005 | Rosen | E04C 2/521 | 52/220.2 |
| 2010/0229472 | A1 * | 9/2010 | Malpas | E04F 17/08 | 52/79.1 |
| 2011/0296778 | A1 * | 12/2011 | Collins | E04C 2/521 | 52/220.1 |

* cited by examiner

INTEGRAL ARQUITECTURAL MODULAR HOUSE ASSEMBLY AND FABRICATION SYSTEM WITH INTERCONNECTING UNIVERSAL WALLS AND UNIVERSAL CONNECTORS AND UNIVERSAL ROOF PIECES

TECHNICAL FIELD

The technical field which deals with the present invention is about prefabricated buildings, specifically the ones referred to modular type constructions.

STATE OF THE ART

The following techniques described in this document differ from the conventional prefabricated construction techniques, where the conventional prefabricated constructions do not manufacture walls, instead, they are manufactured (in situ) from (prefabricated) simple panels, which require first completing the exterior structure, then the power current installation and the placement of doors and windows, resulting into additional operations and costs, considering that these constructions also are subject to individual client's designs, translating into individual initiation and operation costs, while this alternative system, is based on predetermined modular house, which represents the core invention, since these models are created on the basis of three (3) related inventions, which results in simplifying dozens of processes or maybe more, of a typical construction. In the manufacture of these three (3) interrelated basic inventions with which, the predetermined models hereunder presented, were finally developed. These three (3) basic inventions possess unique claim characteristics, which achieve an unequaled simplicity in the construction of prefabricated houses, result in savings in operation costs resulting in a very low cost and price. This document describes a "UNIT OF INVENTION".

"Unit of Invention" Description

The following invention consists in the integral manufacture of various predetermined house models in bases of WALLS, CONNECTORS and ROOF COMPONENTS completely equal one to the other, in order to optimize the process.

This means, that with three (3) types of sub-products, we can build a house. This does not imply that in some punctual cases, some unnecessary details may be omitted, which simplify even more the manufacturing process of these three (3) basic elements; inventions in their own right.

This system achieves two important things: First the setup of a very simple factory, since only three (3) elements need to be manufactured, making the initial capital investment much smaller than what it would normally be, and second optimizing a house construction process and cost operation into a house manufacturing process and cost operation. (very important), meaning that with this integral system, the construction processes are replaced with manufacturing processes, optimizing in this way the production capacity, as well as optimizing the production system, and optimizing the products due to the possibility of specialization in the production process. It's worth mentioning that if on one side we have the benefits of serial production just described, on the other we are limited to our plans and to the predetermined requirements of our system of production and manufacture. We want to emphasize that this system finally results in making houses, but for this end, we need to do three (3) semi-products with specific details which are explained hereunder, which are universal and unique in a construction, and each one does not function without the other components, reason why it is called an integral system. It is very important to highlight in our application that our system is a group of inventions related to each other, denominated "UNIT OF INVENTION".

Adding another virtue to the invention, we are achieving a new standard of quality of life for the low income families thanks to the reduction in operating costs achieved with the Units of Invention.

The three System Elements are three related inventions which are components that make up a principal invention, which are the models shown hereunder.

a) The Universal Wall:

The walls have the distinction to possess all exterior and interior finishing detail, as well as door, window, drain and water circuits, outlet and inlet switches. These walls contain a unique power current circuit in the interior which allows a coincidence with the other walls, as well as when referred to the plumbing circuit.

This wall is a standard piece, which is made so that this same unit can be used for the assembly of various models of modular homes, that is universal standard walls, which can be connected wall with wall, through a universal connector, and always after connecting, it permits the correct functioning of the services (electrical and plumbing) once the installation of the houses is complete. With respect to this last point, this standard universal prefabricated wall contains in a fixed and predetermined position, spaces, openings, electrical and plumbing circuit, as well as switches, sockets, amongst other electrical devices, as well as predetermined positions for doors and windows.

The wall may function with various construction materials, such as the concrete, wood, melamine, plastic, metal amongst others. The universal walls rest in channels placed in the floor which seal and waterproof all of the house perimeter and interior areas, so that once connected these walls form the desired modules according to the predetermined model plans.

All universal walls have in common that the exhibit a 2.40 m high, 3 meters high and 10 cm thickness; and all exhibit the same power, water and drain circuit, ready to be used, or simply circumvent it if not required. The simplification of the dimension and circuits positions is a factor for the lowering the manufacturing operations, for being only one the wall to manufacture and in this way optimize the production speed to the maximum, since it is a universal wall which will be manufactured in series.

b) Universal Wall Connector:

It is constituted by a square tube where each one of the sides have two guides which serve to fasten the "C" channel which finally will hold the wall, and a cover which covers the unused sides. In the top inner part of the connector, are the power current connector "female-ended" which split on all sides and will plug in with the wall connectors "male-ended".

In the inferior part of the Universal Connector, is a free pass which gives play to the flexible tubes (not rigid) that come out of the wall, for the water connection which is always straight in our designs.

The inner part of the Universal Connector is filled with thermal acoustic material, to insulate the cold/water pass and sound through them.

Finally the cover guides for the sides in disuse, which also function as decorative pieces.

This Universal Connector was created to standardized spaces composed by the Universal Walls by a facilitating their homogeneous placement, and the pass of power, water and other services through them.

In the sides of the Universal Walls are the Universal Connectors, which, as their name indicates serve to connect one Universal Wall with another, at the same time serve to connect the circuits (cables and ducts), in such a way that, when the placement is finished, all circuits of water and drain and light and power switch will be ready to use.

Within our Universal Connector, we have an electric power pass, permitting the necessary current flow to each wall at the moment of installation.

We also have, covers for the sides of the Universal Connector that are not in use, or which are not necessary for the moment until the next house remodeling.

Once connected the light and water and their respective plugs and jacks, we use bolts to bolt in the "C" channel of the Universal Connector with the Universal Wall, in order to secure it in this way c) Universal Roof Piece The roof is a piece with strategic electric current connection points, which coincide symmetrically one with the other with the wall outlet point, which is special for its position and coincidence in all our house models constructed with this system, and which are numbered and shown in our claims and figures. This roof piece, once installed, will have the lights placed and correctly functioning in all of the house, by being in coordination with the spatial distribution of the light switches in all of the Universal Walls, resulting in the correct "off and on" switching of roof lights.

These roof pieces are fastened one to the other with metal plates which serve as leveling pins, to obtain an even and leveled roof, a flat ceiling is seen from the inside of the house, and the view from the outside shows a gable roof, or flat roof without changing the system, it being an obvious detail. In the graphics we appreciate a roof piece where in each extreme, it has a square shape, one smaller than the other, which permits mounting these two extremes, while joining roof blocks from right to left, instead than from bottom end to upper end, in order to achieve a waterproof effect between blocks or roof pieces. Our roof piece is also symmetrical and universal, as the Universal Wall.

This Universal Roof pieces has a hollow interior where the light system of cold light has already been installed, chosen not only for energy savings but also because it offers higher security than conventional systems of light. Each Universal Roof piece has a current inlet and an outlet always in the same site, it has Universal Roof piece to Universal Roof piece auto connectors, as well as Universal Roof piece to Universal Wall direct connections, plugable to one another, always in the same site and position, making thus our roof pieces a Universal Roof pieces, characteristic which is crucial in our system, due to its simplicity and operation savings.

BRIEF FIGURE DESCRIPTION

We want to make clear that in order to capture explanatory figures in this document, circumscribe the system hereto described, to the materials exposed in certain figures. In this system or unit of invention, no matter what materials are used, what matters is the correct functioning of the system.

FIG. 1: This figures shows the basic wall, without details, of 2.40 mts high and 3.00 mts wide and 10 cm thick.

Figure 2:
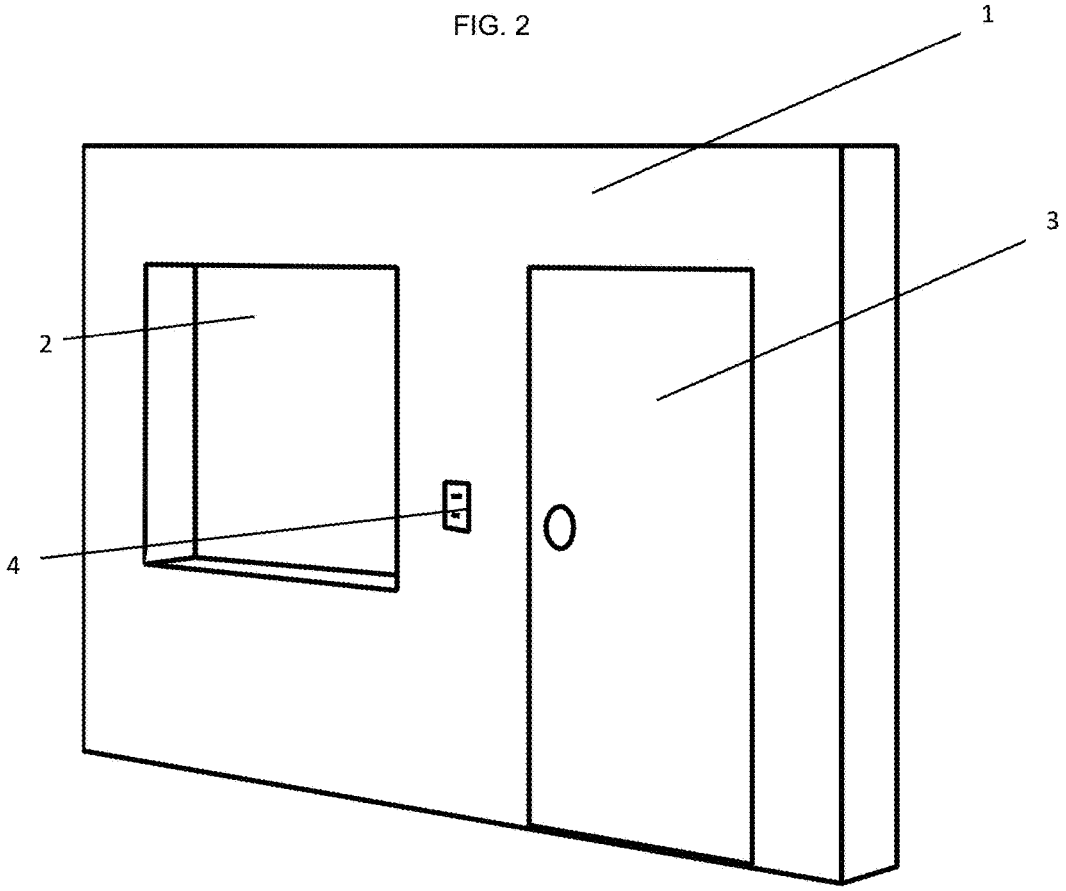

FIG. 2: This figures shows the position of the door, window, power switch, power outlet in each wall, the door and window can be bypassed in case of not being needed, creating savings in specific cases.

Figure 3:
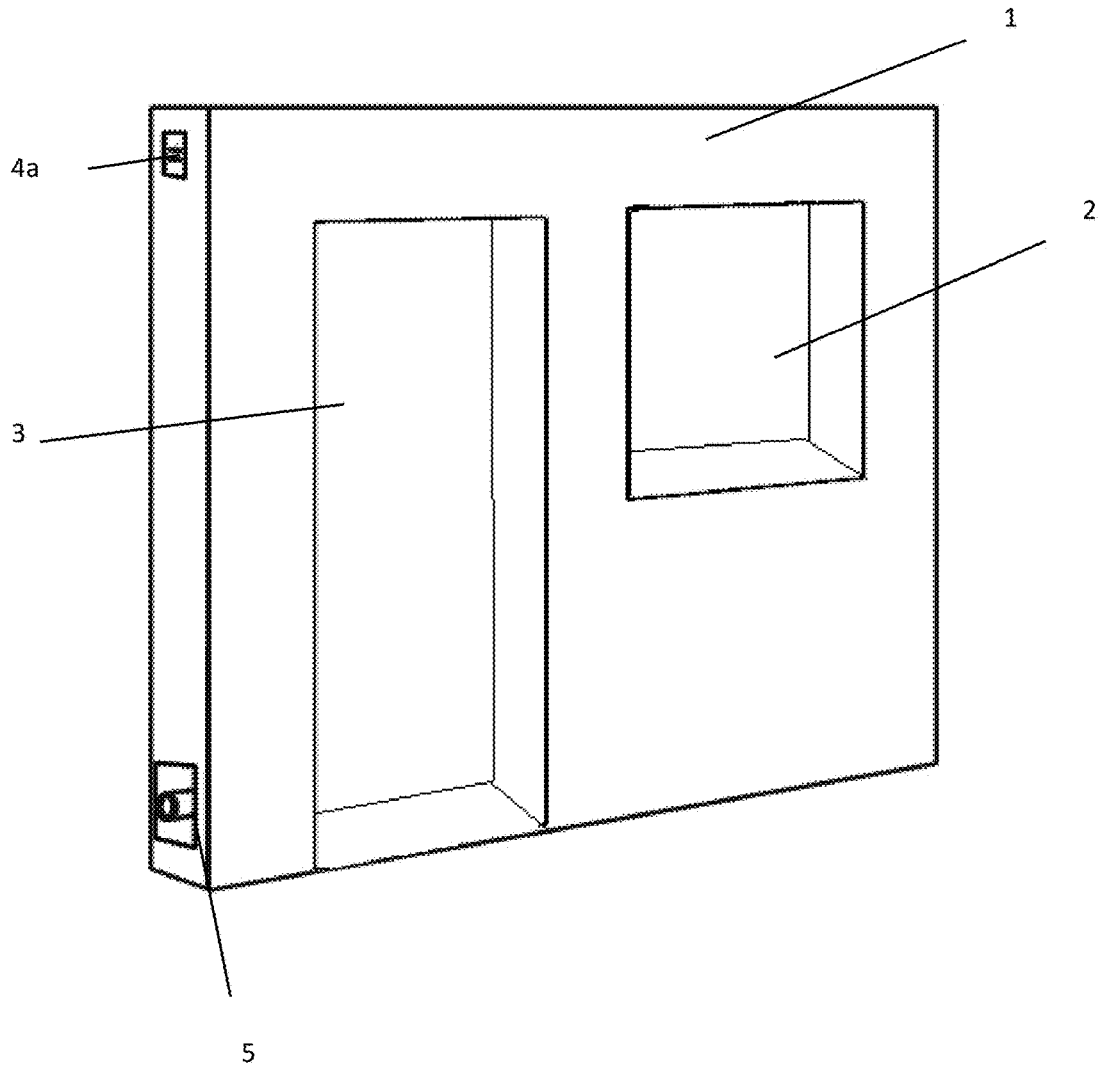

FIG. 3: Power current position links are shown in green (3.1) and water and sewer connection link in blue (3.2).

Figure 4:
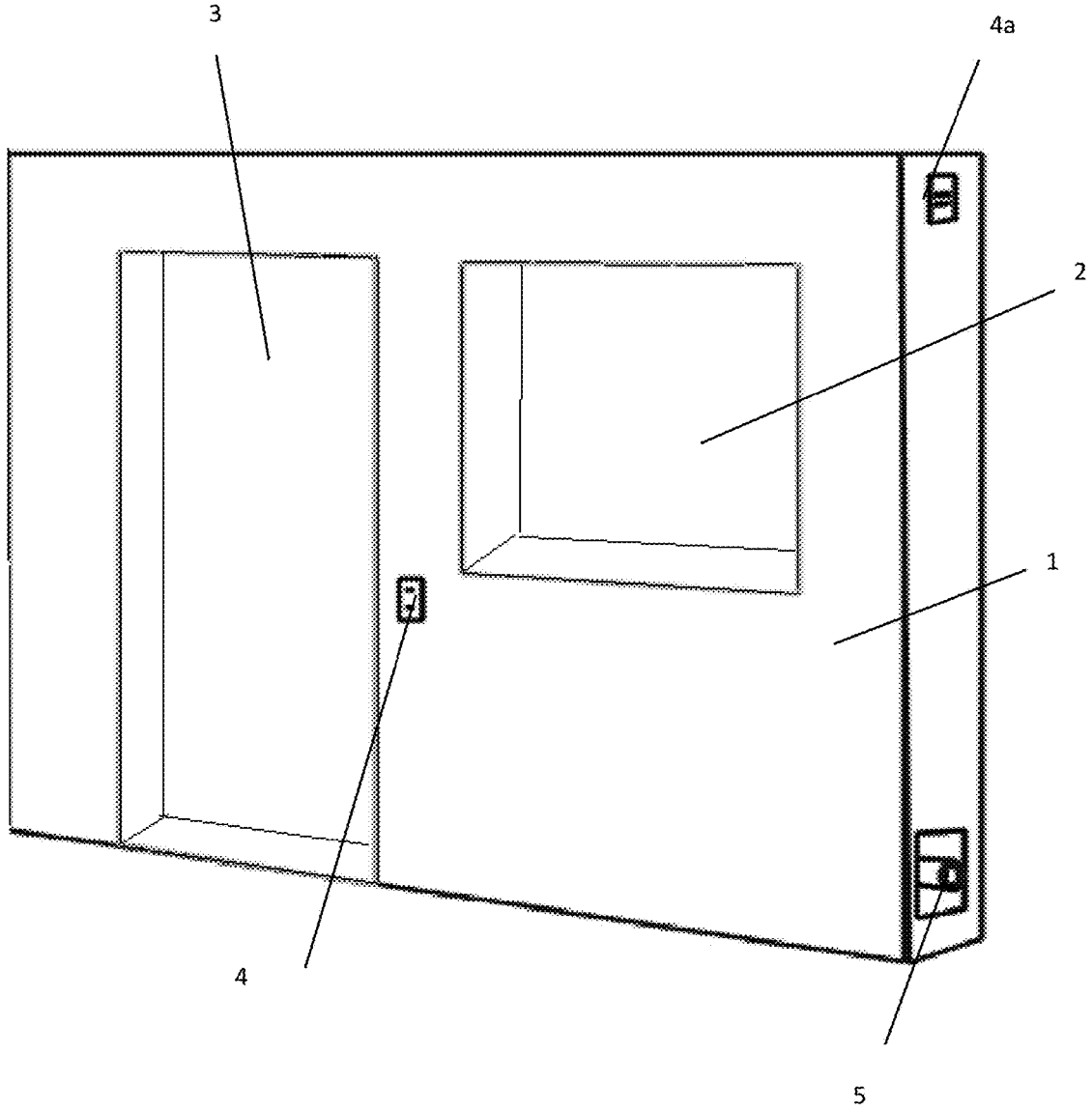

FIG. 4: Another view of the power current and water and sewer links (3.1, 3.2).

Figure 5:
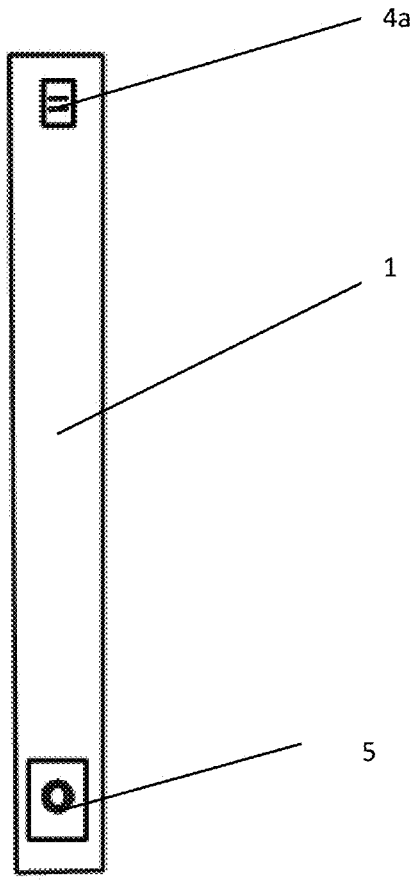

FIG. 5: Lateral view of the wall with water and current links.

Figure 6:
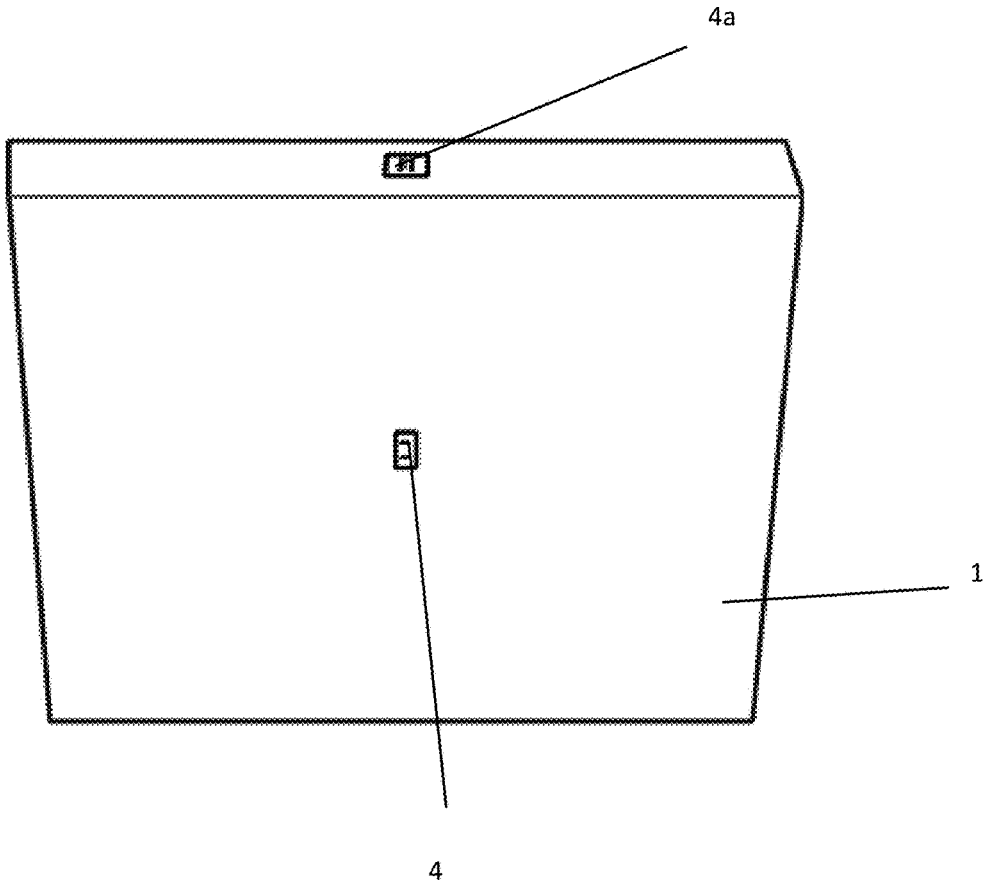

FIG. 6: View in perspective of wall/roof power current links (6.1) and electrical outlet and switch (2.2).

Figure 7:
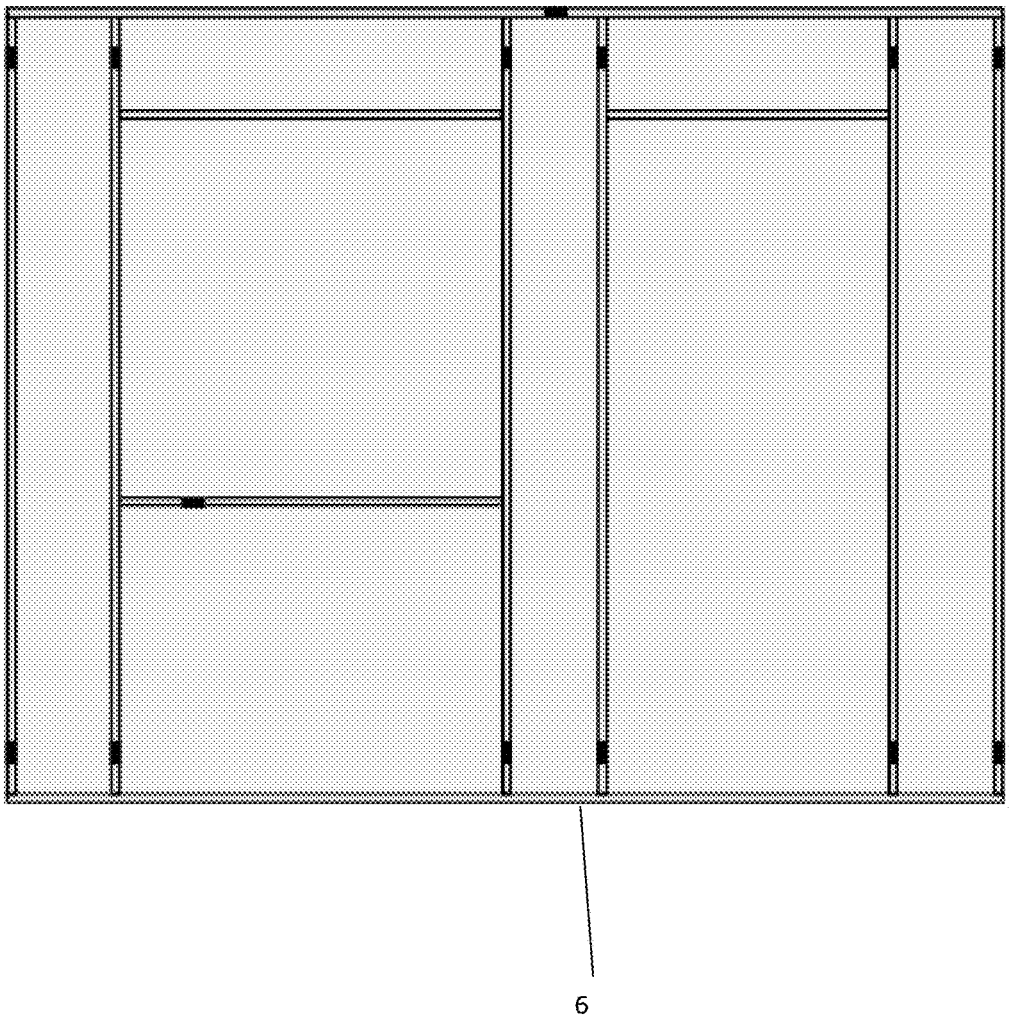

FIG. 7: Possible internal structure of universal wall, not necessarily the only one.

Figure 8:
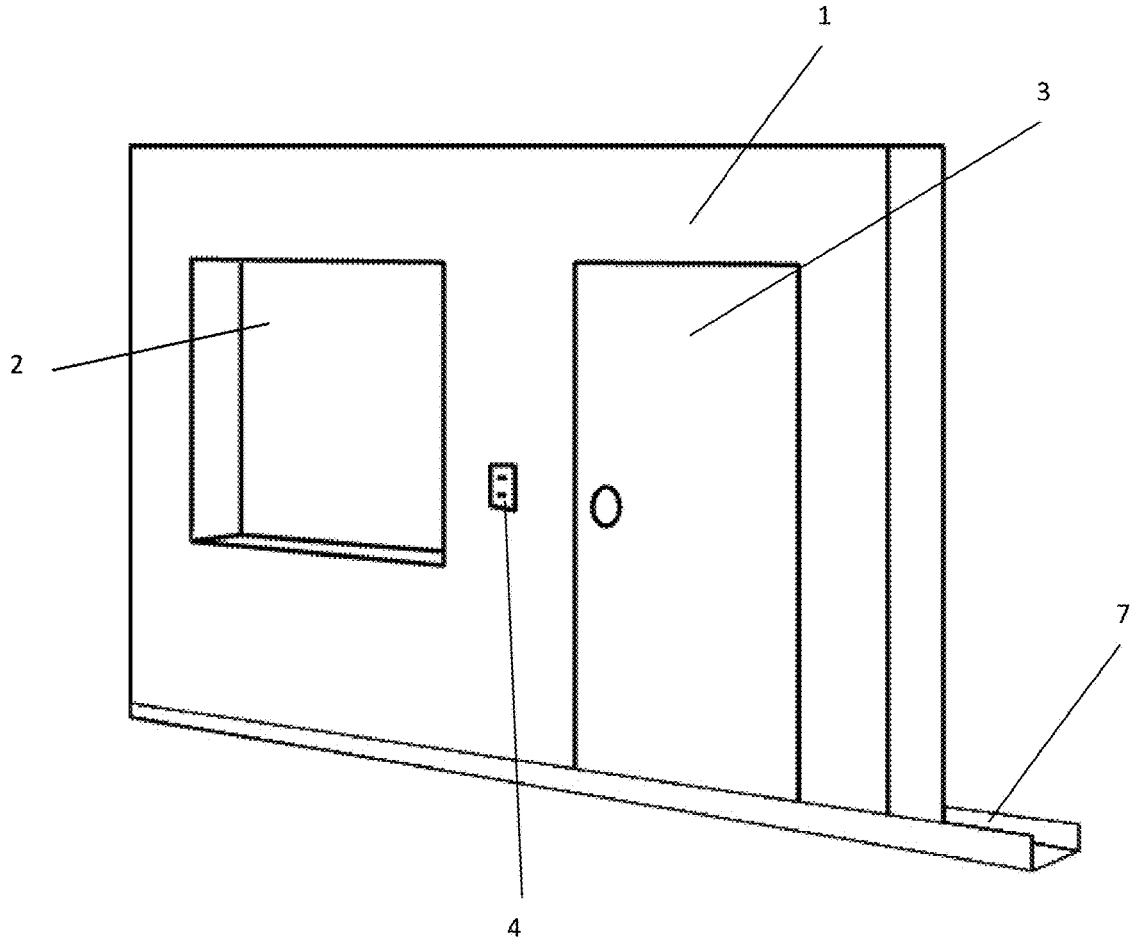

FIG. 8: Shows wall fastening channels.

Figure 9:
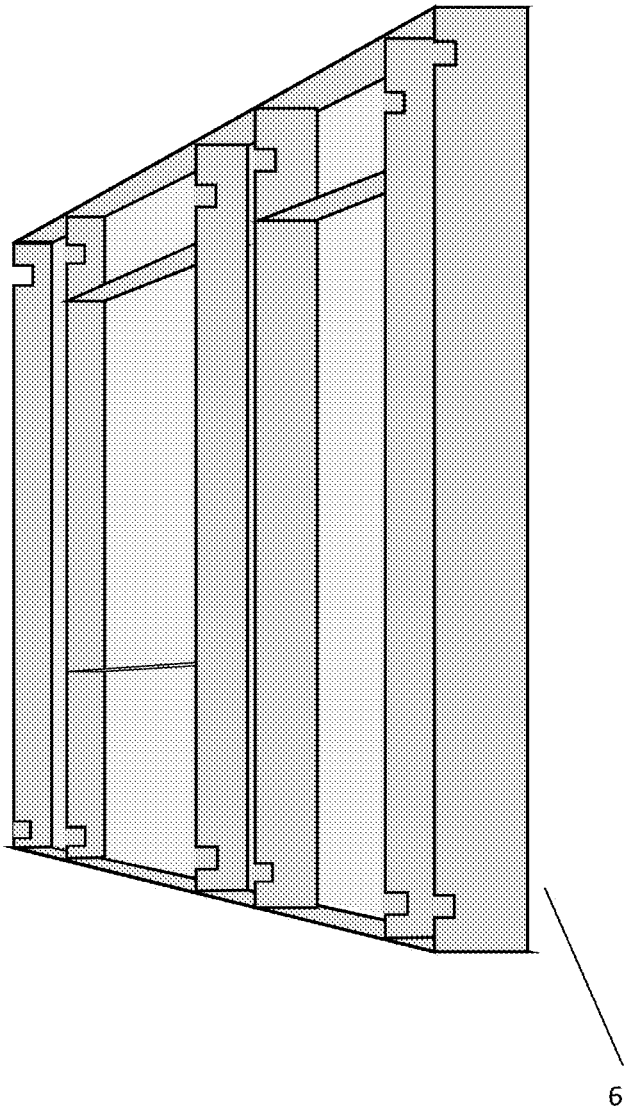

FIG. 9: A possible inner structural distribution of the universal wall, frontal view.

Figure 10:
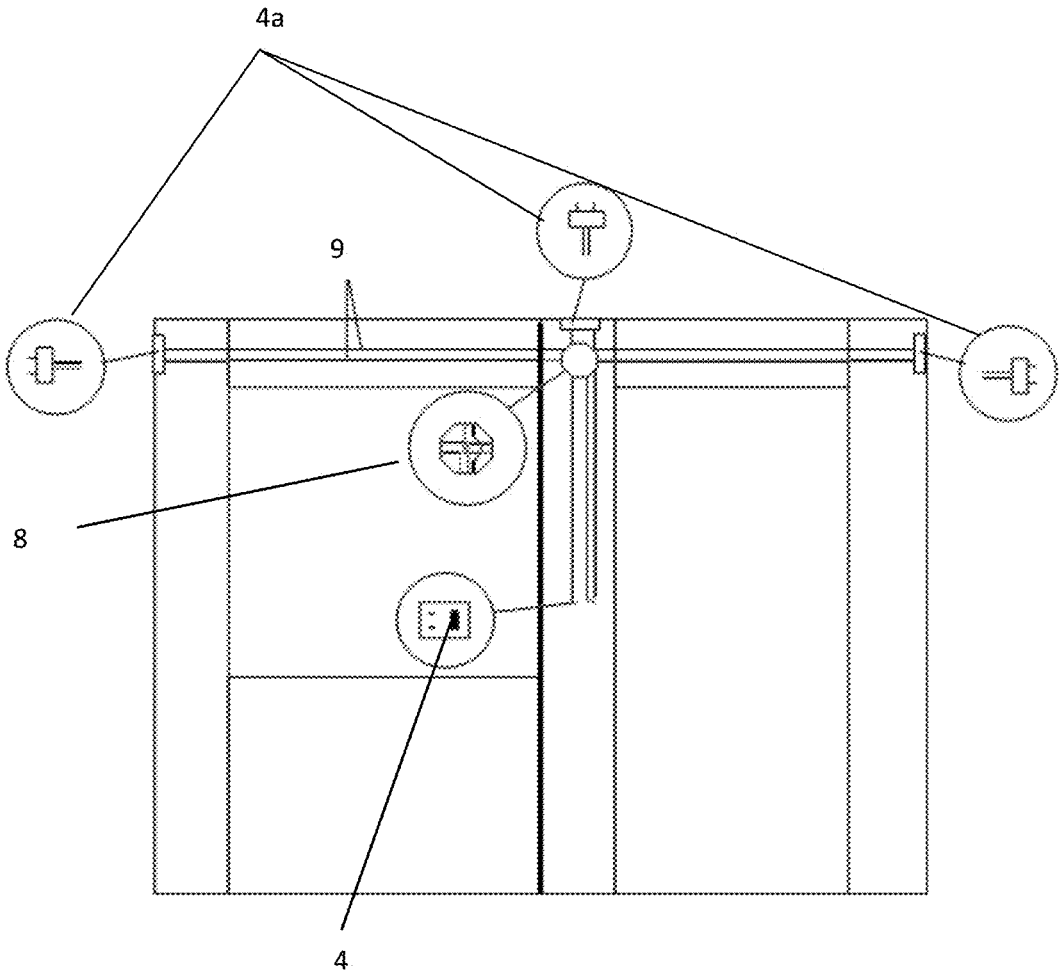

FIG. 10: Electrical distribution of the universal wall.

Figure 11:
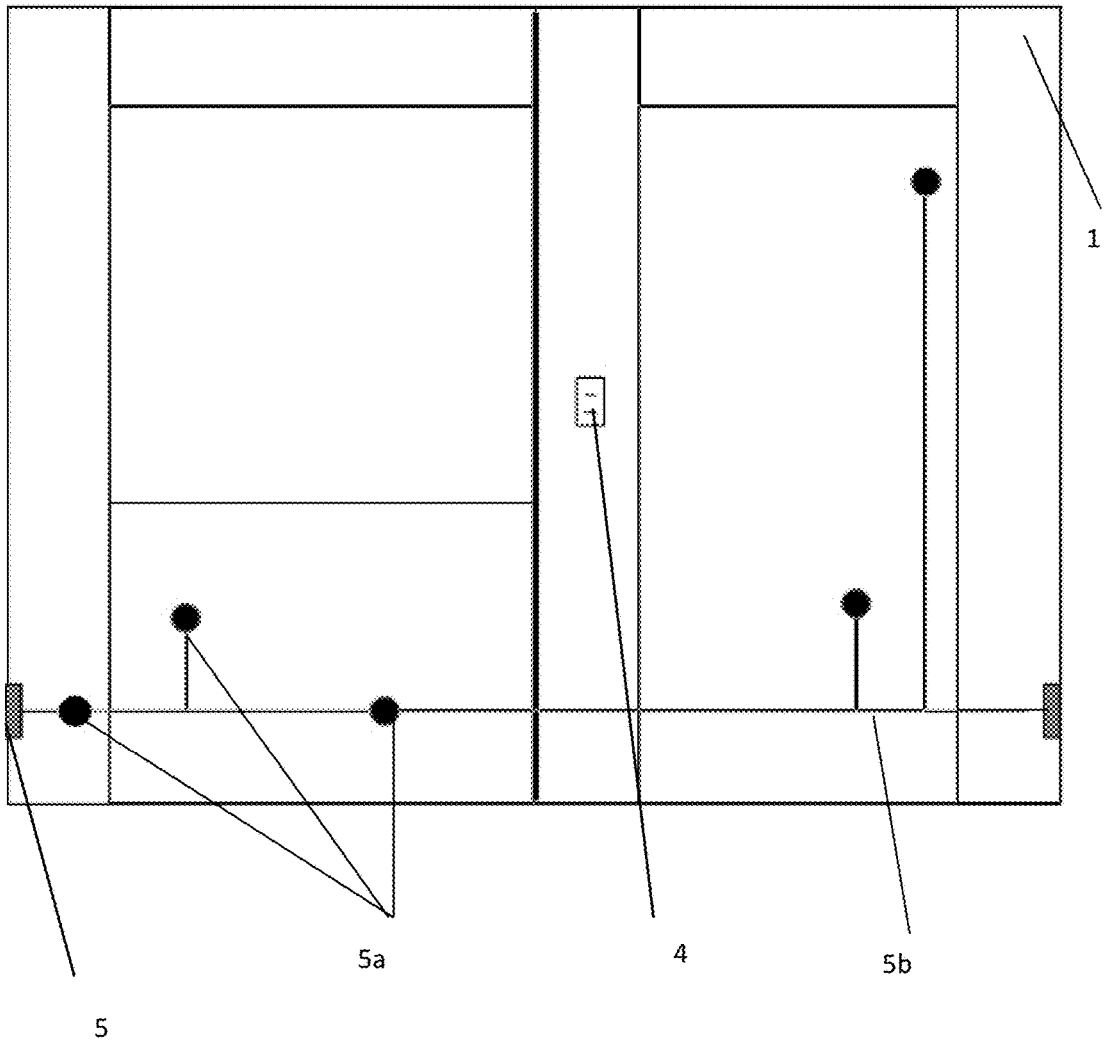

FIG. 11: Wall with water outlets and plumbing network links

Figure 12:
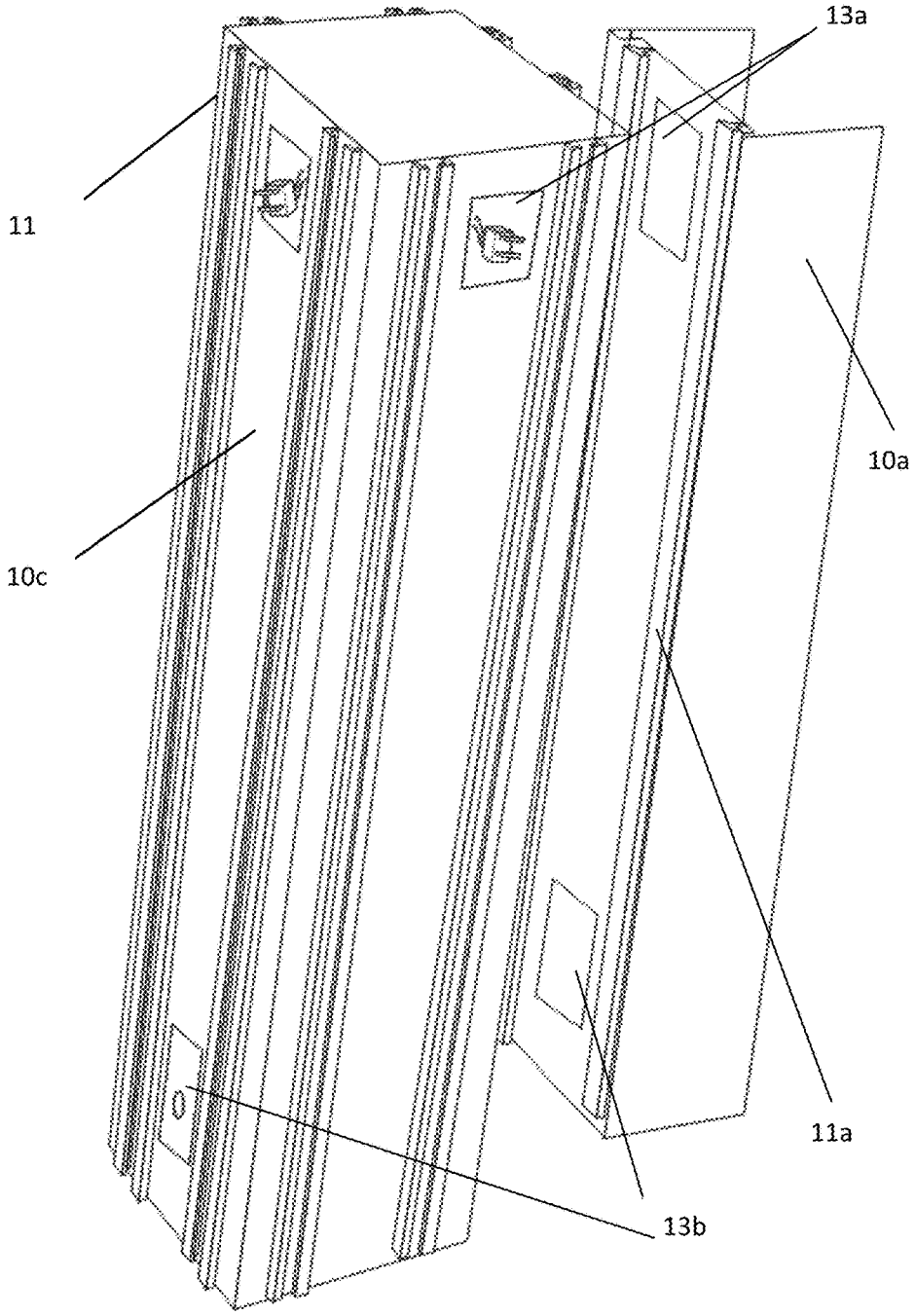
Figure 1:
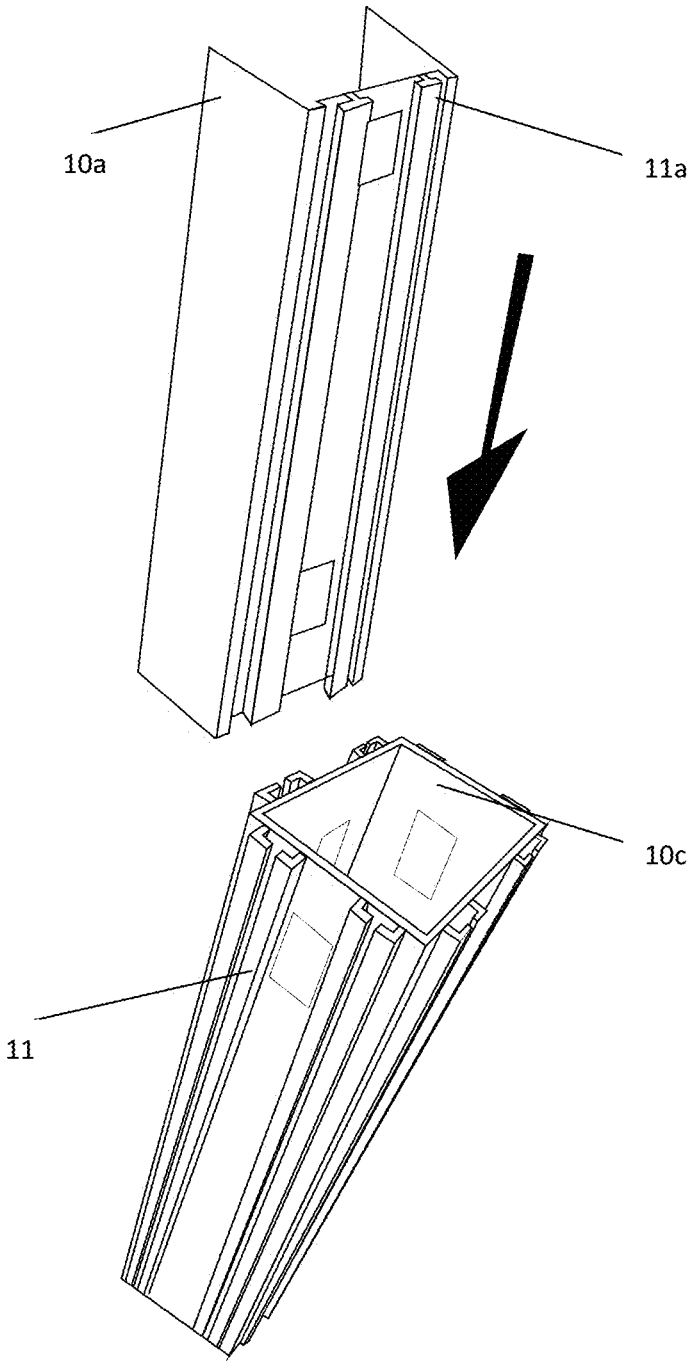

FIG. 12: View in perspective of wall connector with interconnecting channels.

FIG. 13: 3-D view of the "C" channel showing "T" rails, which fit the square tube guides (connector), shown hereunder.

Figure 14:
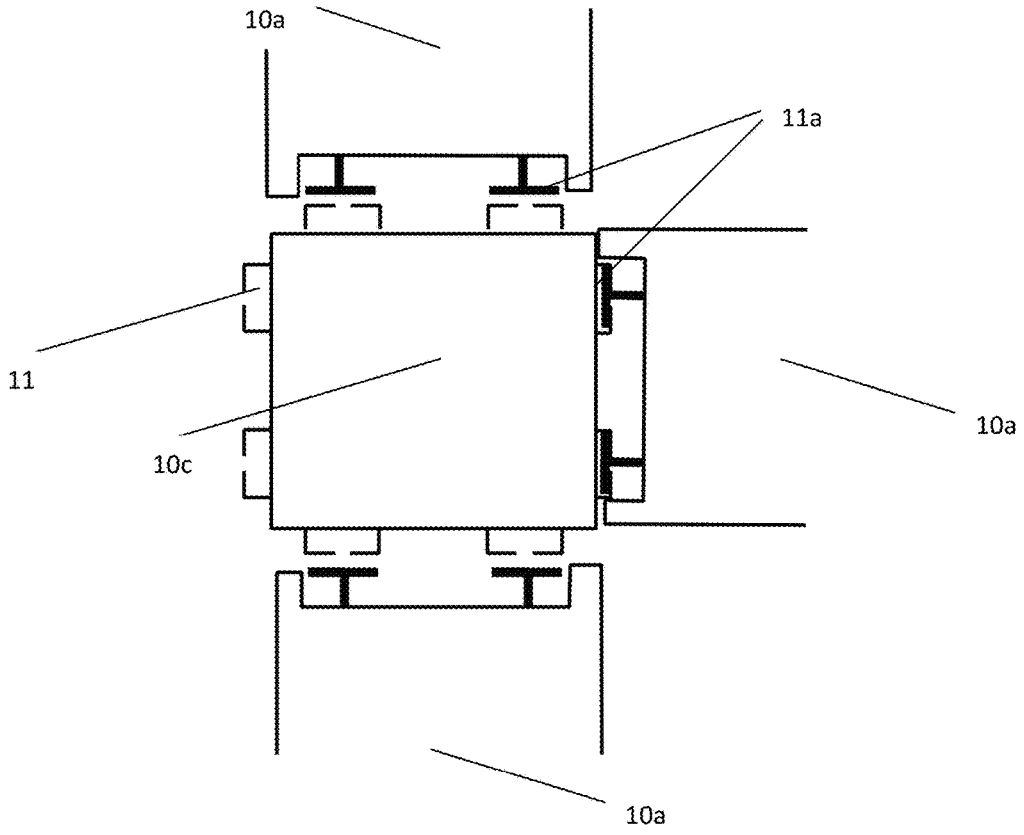

FIG. 14: Plant view with the rails placed and in placement as well.

Figure 15:
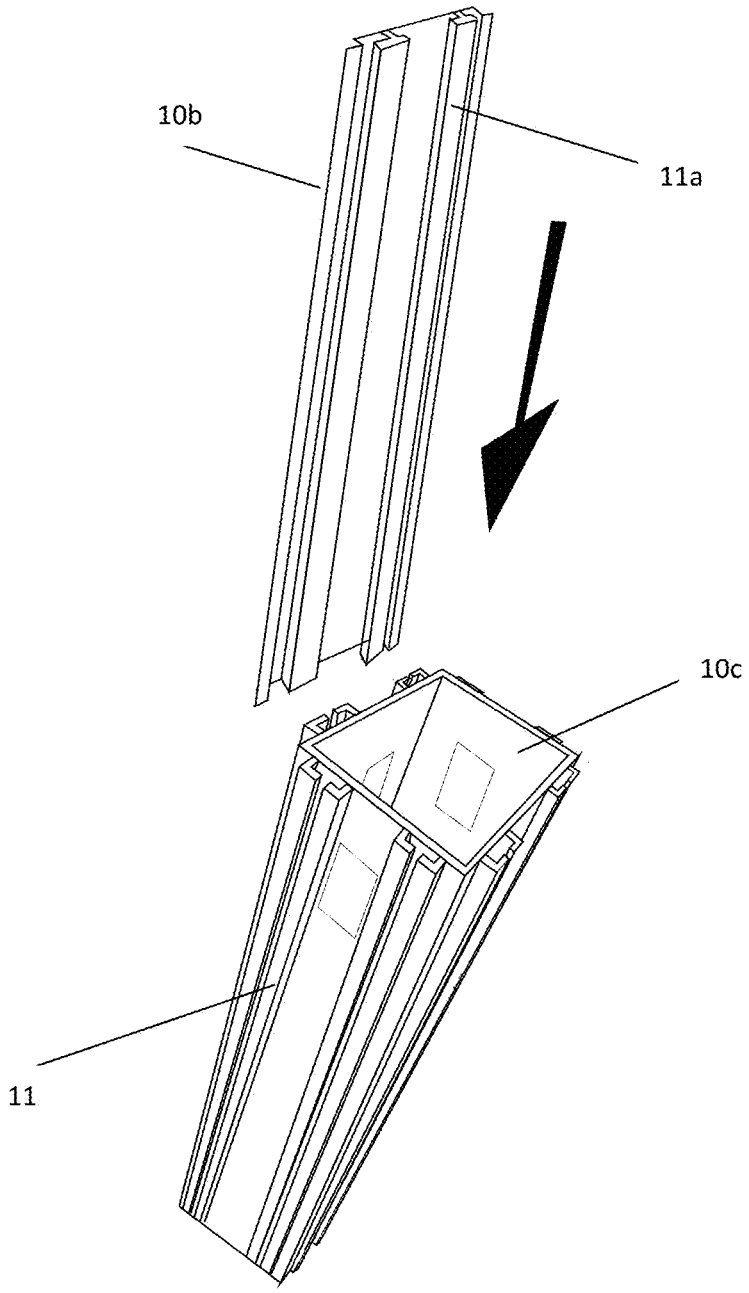

FIG. 15: Perspective view of the decorative cover of the connector.

Figure 16:
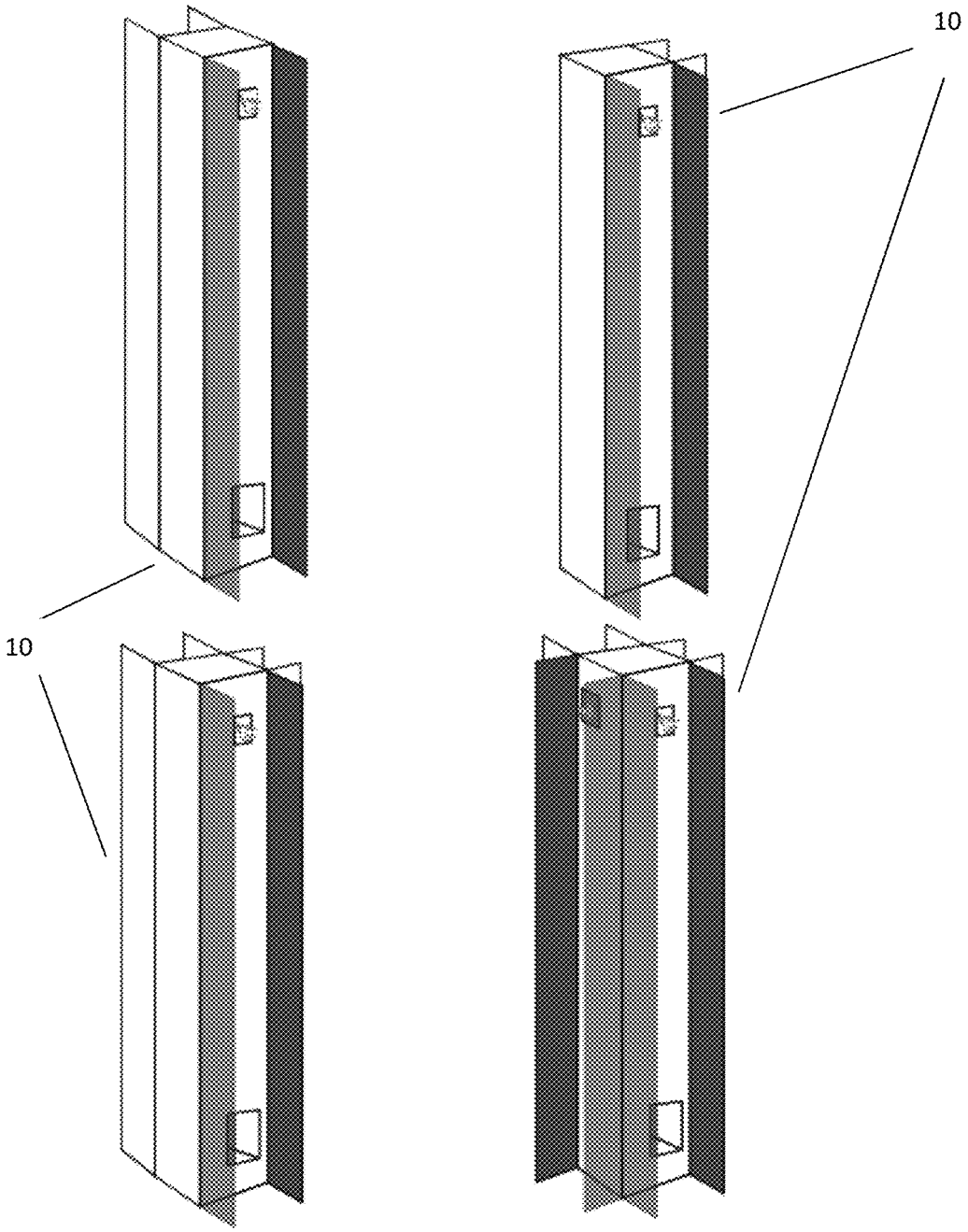

FIG. 16: Explains the positions of the placement of channels, which can be of 2 to 4 used sides.

Figure 17:
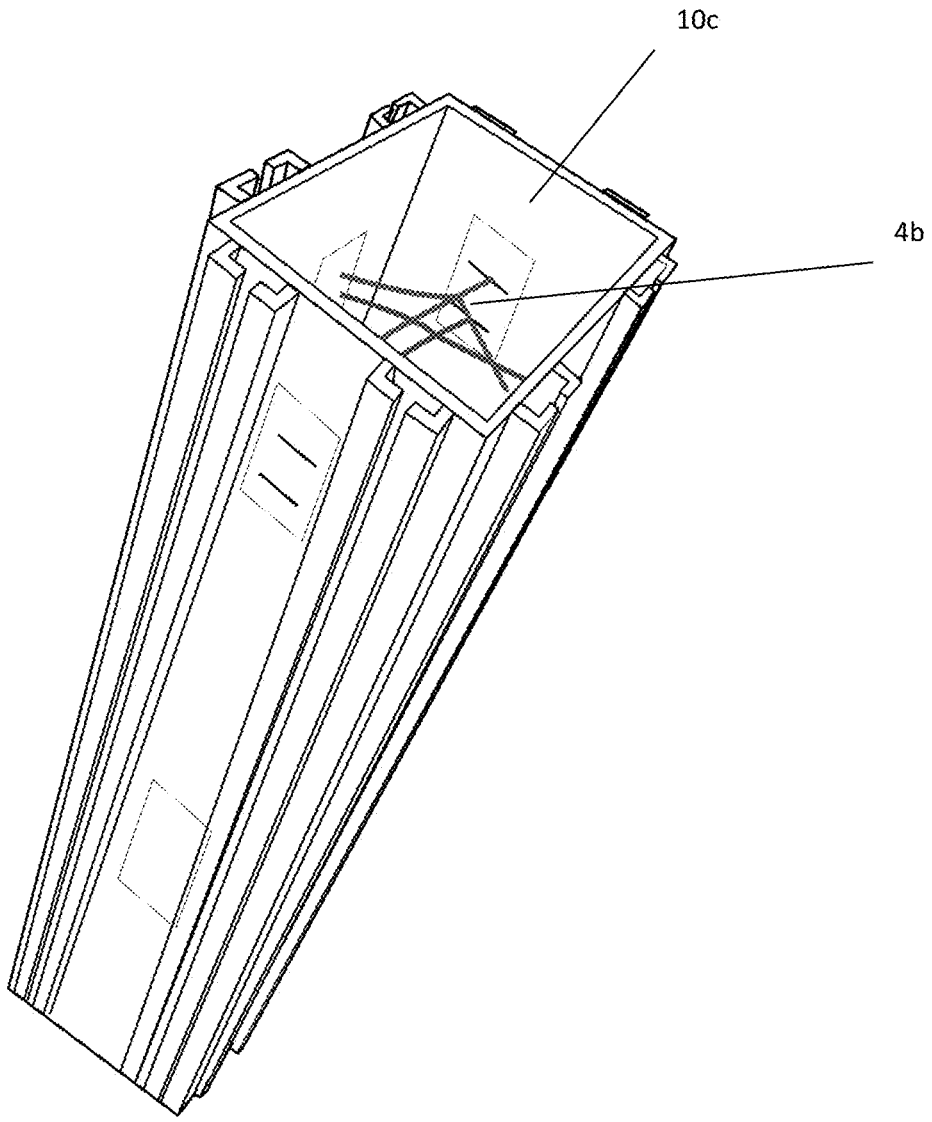

FIG. 17: Sample of a current network distribution for it to be universal.

Figure 18:
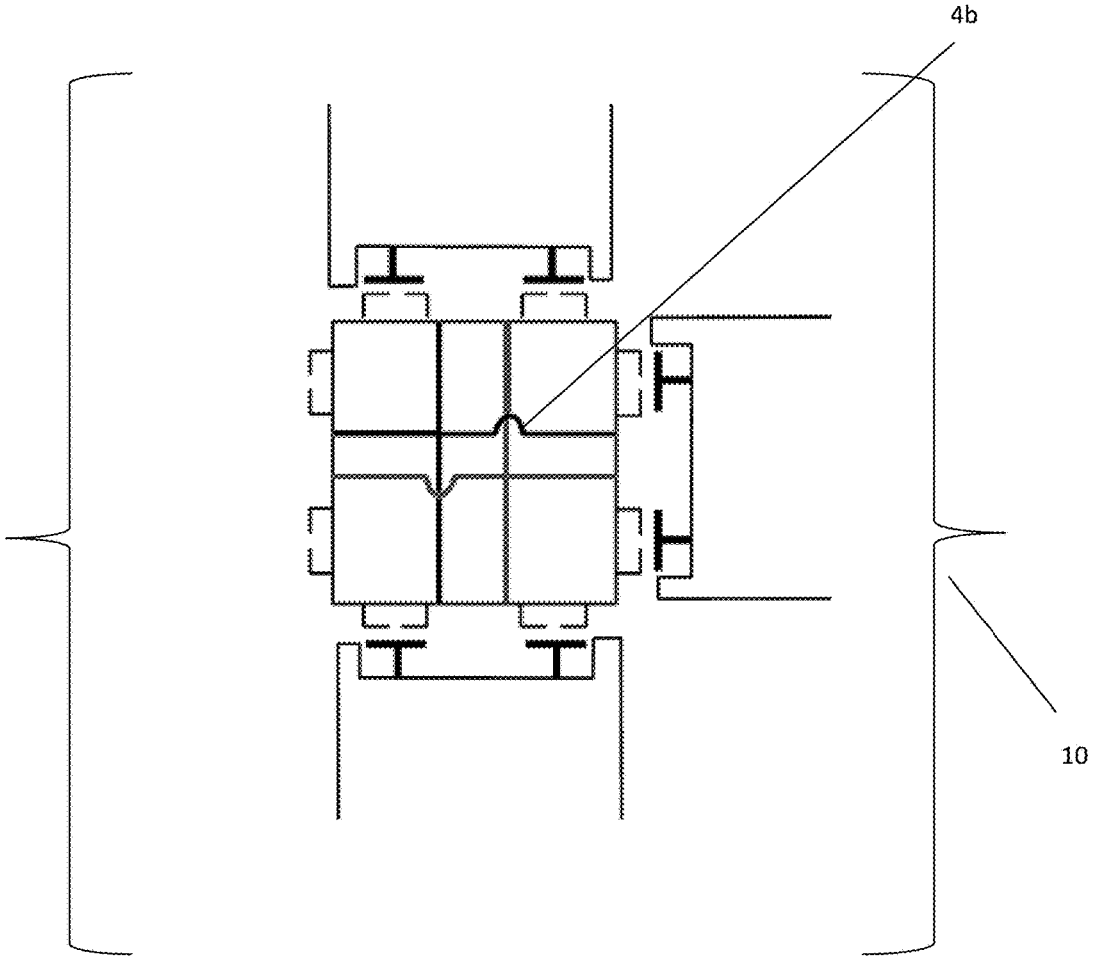

FIG. 18: Plant view of a sample of electric distribution.

Figure 19:
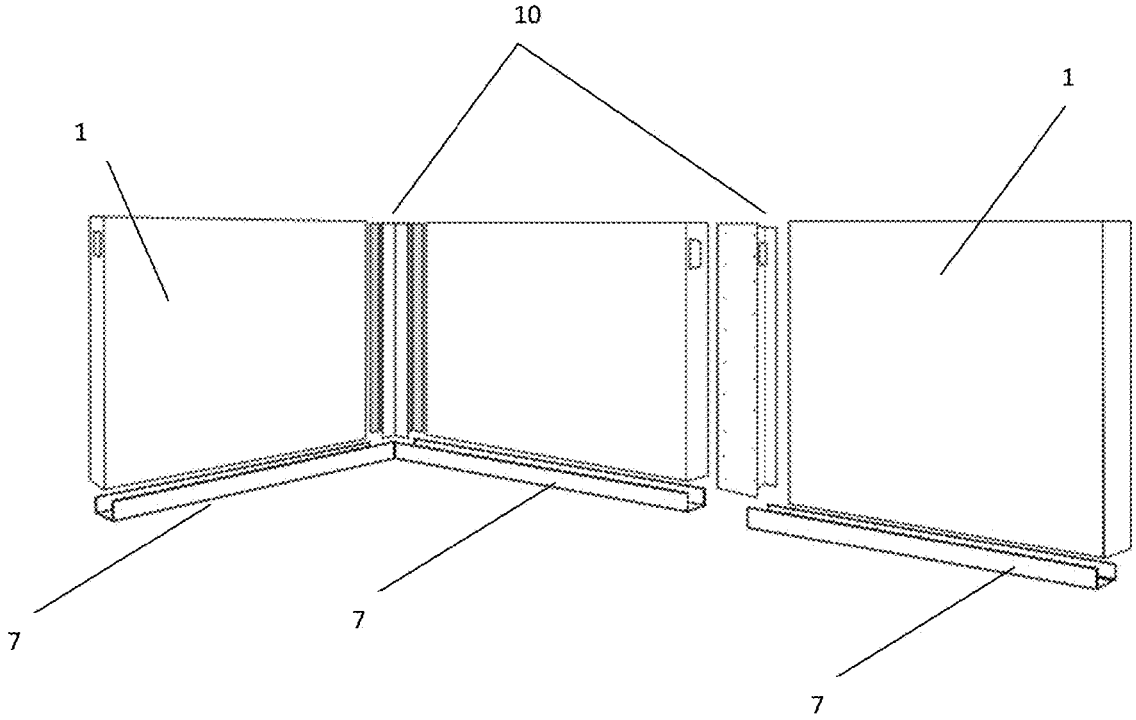

FIG. 19: Sample of connections of wall and floor.

Figure 20:
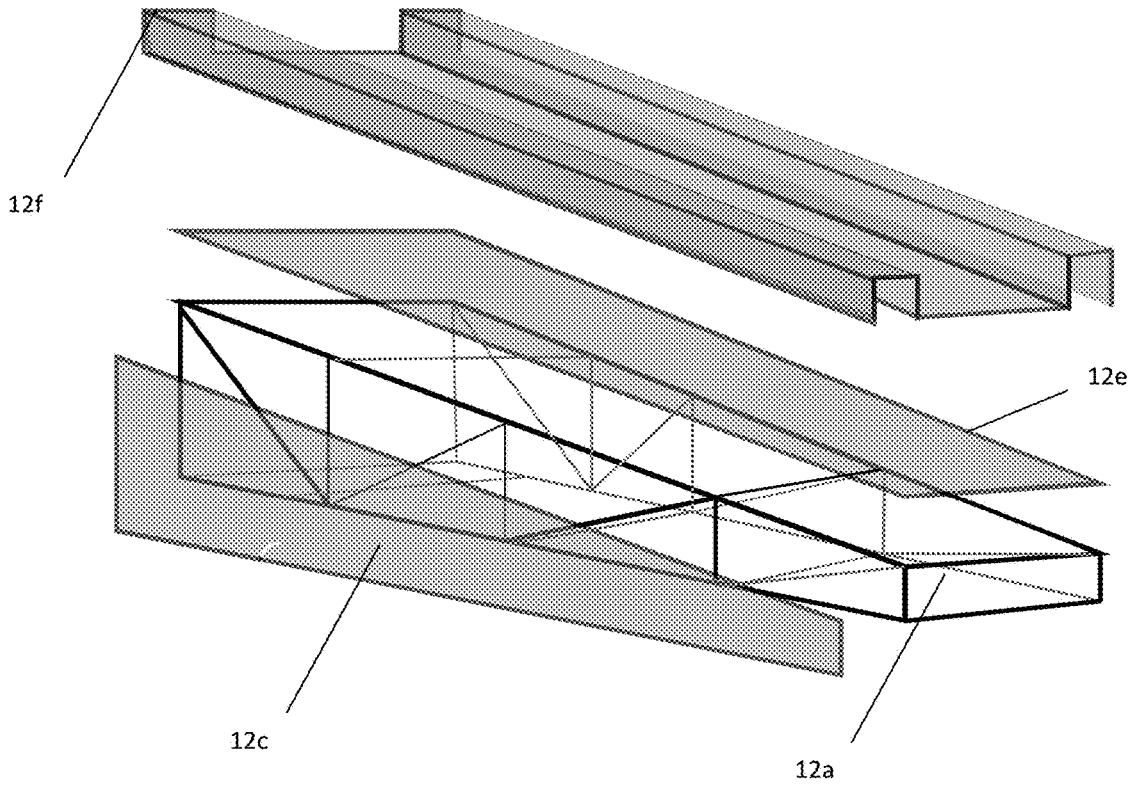
Figure 21:
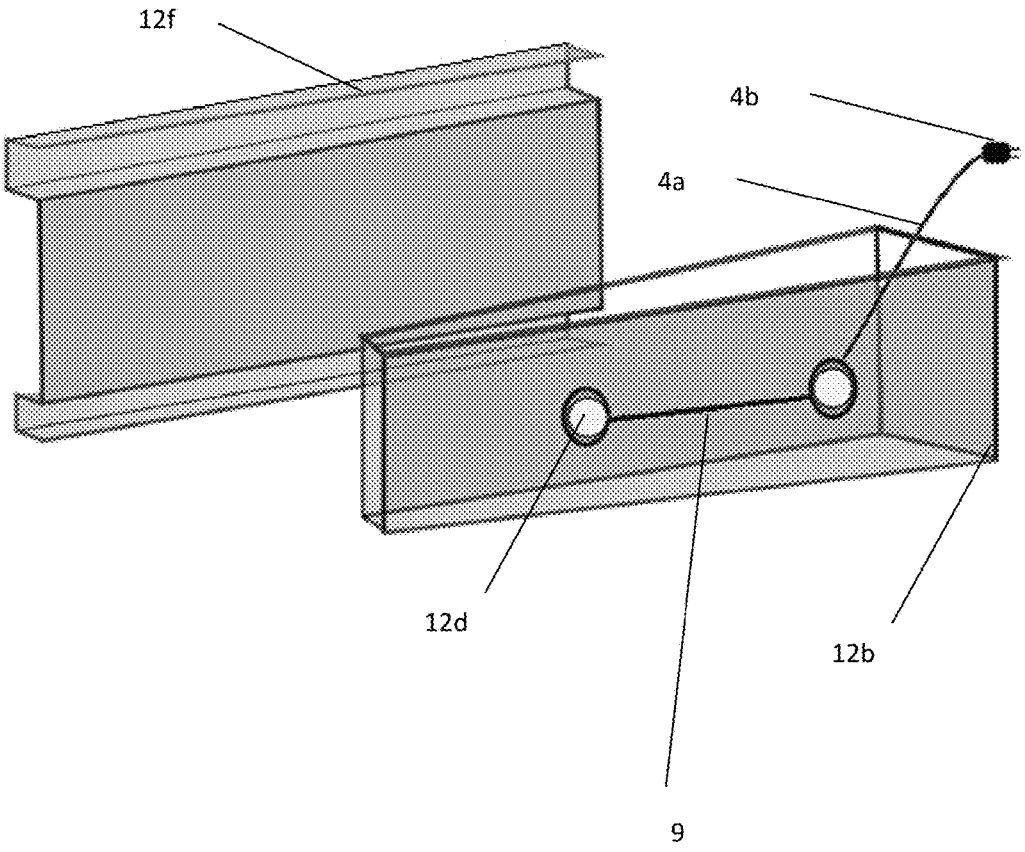

FIG. 20: Sample of roof piece and its structural parts, such as special top structures for right to left coupling, flat support, and a top linking structure FIG. 21: Sample of electrical current inlet position in the roof piece, unique light position in all pieces and current network.

Figure 22:
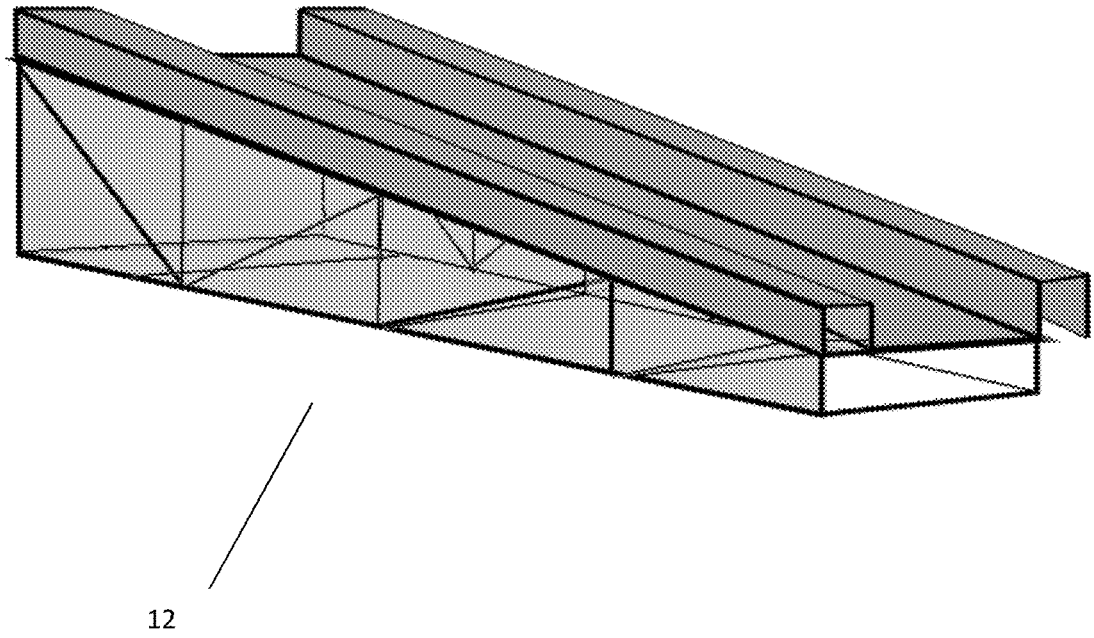

FIG. 22: Another lateral view of the roof piece.

Figure 23:
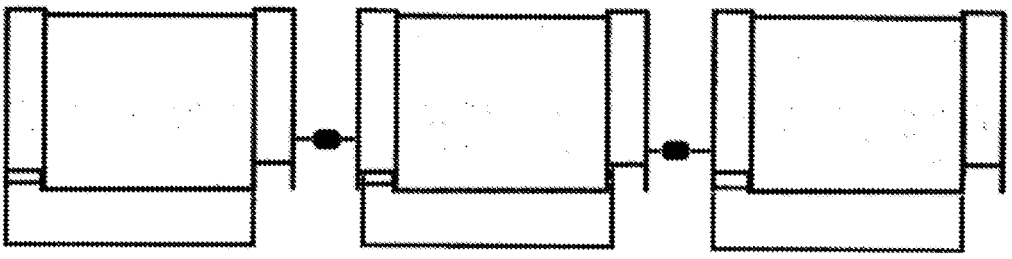

FIG. 23: Depicts special form of coverage, where the left side wraps around the rights side, in such a way as to prevent water leaking; view of three separate roof pieces, ready for right to left coupling.

Figure 24:
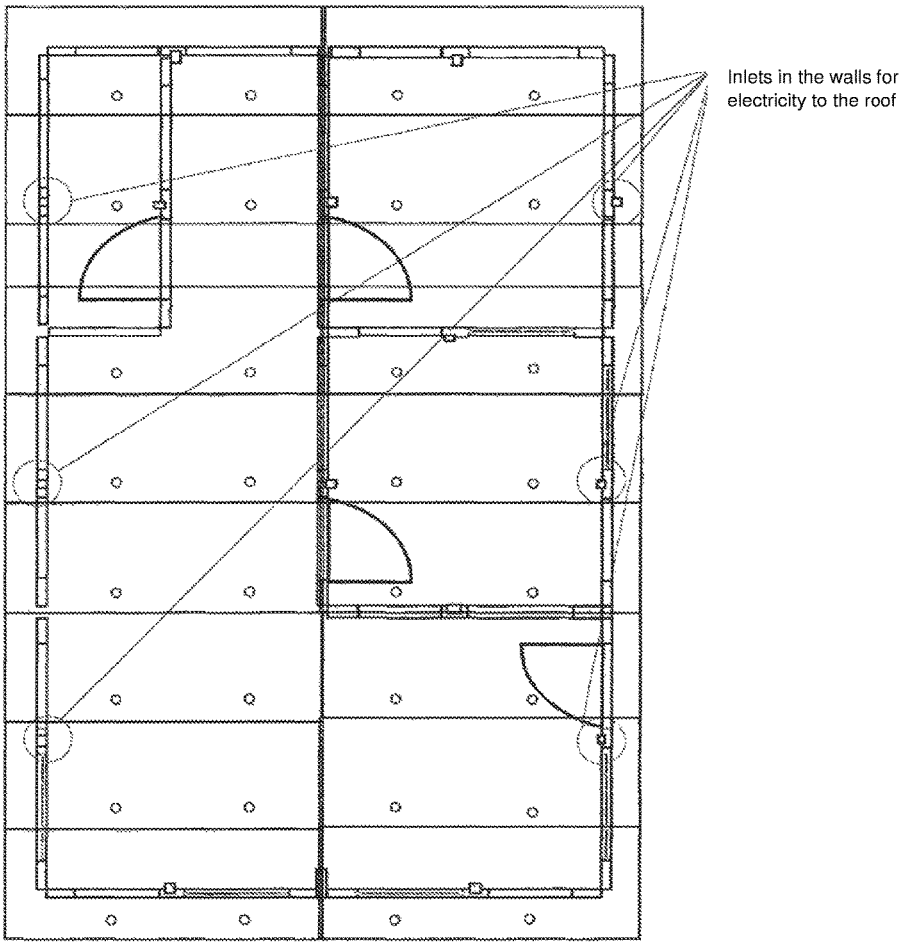

FIG. 24: Top Plant view of the distribution of all the pieces that make up the roof and the fit of the wall and roof connectors

DETAILED DESCRIPTION OF THE INVENTION

The modular architecture construction system of this invention comprises universal walls, connectors, and a roof, i.e., each of which are completely equal to each other; they are complementarily coupled and they internally have an electrical wiring network and a network for water, which is characterized by:

a) Walls

The walls have the particular feature that they are all equal to each other, i.e., they are universal, and they have all exterior and interior finishing details as well as a door (3), a window (2), channels for water to pass through (5), switches (4), among others. In addition, each wall contains an electrical wiring circuit inside (9) that allows for exact matching with the other walls, as well as when referring to water pipes.

This wall is a standardized piece that is made so that the same wall can be used for the total assembly of several models of prefabricated houses, i.e., that they are universal walls. Because of this fact, it is possible to connect one wall with another wall (through a universal connector (10) and the walls will always coincide. In addition, the already structured walls allow for the correct operation of the (electricity, water and drainage) services of all the houses. With regard to this last point, these walls do not only have spaces or holes but they also have pipes and wiring for water and electric power respectively, as well as switches, outlets, among others, besides doors and windows, which have a fixed (predetermined) position on all manufactured walls.

The walls work with any type of building material, e.g. concrete, wood, melanin, eternit, plastic, metal, etc. To install the walls, they rest on channels placed on the floor that seal and waterproof the whole perimeter of the house and the interior area at the same time, so that once these walls are joined they form the desired modules according to the blueprint of the predetermined models.

What all these walls have in common is that they are 2.40 meters high×3 meters wide and 10 centimeters thick. They have all electric, water and drainage connections and/or circuits ready to be used or circumvented according to need, thus optimizing production speed due to its mass production.

b) Connectors

These are made up of a universal connector (10) which is a quadrilateral tubular structure (10*c*), characterized because in the inside it has an electrical wiring network at the top (13*a*), and a free passageway for wall water pipes at the bottom (13*b*), wherein the wall (1) connection and coupling points to the "C"-shaped channel (10*a*) of these networks are located on each side, at the top for the electrical wiring (13*a*) and at the bottom for the water network laying (13*b*). Likewise, each side has (11) guides which hook onto and fasten the (11*a*) structure of the "C"-shaped channel (10*a*), which in turn is attached to the wall (1).

Additionally, the connector (10) may rest on the channels (7) located in the perimeter of the house and of the insides for better alignment, arrangement, and arming of the rooms. The empty connector (10) spaces may be filled with thermo-acoustical materials so as not to allow cold/heat and sound to pass through them.

The "C"-shaped channel (10*a*) is characterized by the fact that it supports the wall (1) and it facilitates its connection with the connector (10*c*) thus with another wall (1). It has two spaces (13*a* and 13*b*), wherein space (13*a*) is found at the top and allows for the electrical wiring to pass through and space (13*b*) is located at the bottom and allows the water network to pass through. It is also characterized by the fact that it has (11*a*) channels which complementarily hook onto (11) guides.

The cover (10*b*) has an internal and an external part. The external part is flat and the internal part has (11*a*) channels that are complimentarily hooked onto the (11) guides.

c) The Roof

The roof (12) is made up of pieces which are characterized by the fact that they have a skeleton or (12*b*) inner structure which contains the electric wiring network and it gives (a linear or water fall) shape to the roof of the house. The (12*b*) structure is covered at the top and at the bottom by plates (12*c*), for a better finish and to more effectively cover the (12*a*) structure. The (12*b*) structure has 2 holes (12*d*) for installing lights or other lighting devices, while the (12*e*) structure has no holes. Each piece also has a (12*f*) structure at the top, which serves to link the different parts of the roof (12) and it is characterized by the fact that it has a length similar to the (12*e*) plate with a transversal area having a central gutter and elevated quadrangular ends, one smaller than the other, which serve to hook onto another (12*f*) structure from another part of the roof (12).

Prototype

In order to realize the actual invention, a prototype was constructed that served to define the function details which brought conclusions which led to this invention unit.

The invention claimed is:

1. A modular construction system based on interconnected universal parts comprising:

at least one wall, each one of the walls having a front side, a back side, a top end, a bottom end, lateral sides, an electrical wiring circuit built-in into the top end of the wall, electrical lateral connection links built-in into the wall, wall-ceiling electrical connection links built-in into the wall, a water pipeline circuit built-in into the wall, and corresponding fixed lateral water connection links;

at least one connector to connect adjacent walls, each one of the connectors is formed by:

at least one hollow tubular structure, each one of the hollow tubular structure having a squared cross-sectional area and includes a top end having built in electrical outlet to connect to the electrical wiring circuit electrical wires of the wall, a bottom channel to allow the pass of the water pipeline circuit, and guide elements on each side;

at least one "C"-shaped coupling channel, each one of the "C"-shaped coupling channels having a central section, a first section protruding from one side of the central section, a second section protruding from the opposite side of the central section, a top channel adapted hold the electrical outlet for the connection with the electrical wiring circuit, a bottom channel to allow the pass of the water pipeline circuit, and a pair of "T"-shaped rails protruding from an external side of the central section; an internal section of the "C"-shaped coupling channel is connected to one of the lateral sides of the corresponding wall;

at least one roof piece (12) made up of at least one inner side containing the electrical wiring network, a cover plate which acts as a ceiling, electrical connection links, light sources, at least one smooth support plate, and at least one upper structure;

wherein each one of the "C"-shaped coupling channels has a shape that is complementary to a shape of the "T"-shaped rails;

wherein two walls are connected to each other by connecting each one of the lateral sides of the each wall into the corresponding internal section of the central section of the "C"-shaped coupling channel and then sliding the "T"-shaped rails on the corresponding guide elements of the hollow tubular structure;

wherein when the walls are connected by the connector:

the wall-ceiling electrical connection links, the corresponding top end with the electrical wiring circuit of the one hollow tubular structure, and the corresponding top end having built in electrical outlet of the "C"-shaped coupling channel are aligned, allowing for the walls to match; and the water pipeline circuit, the corresponding bottom channel of the one hollow tubular structure, and the corresponding bottom channel of the "C"-shaped coupling channel are aligned allowing for the walls to match.

2. The modular construction system according to claim 1, the wall further includes a pull box on the lateral sides for the electric wiring circuit and a corresponding socket/switch.

3. The modular construction system according to claim 1, wherein the water connection links are provided on the lateral sides of the each wall.

4. The modular construction system according to claim 1, wherein each one of the walls optionally include at least one of a door or a window.

5. The modular construction system according to claim 1, further including seating channels to support the at least one wall and the at least one connector.

6. The modular construction system according to claim 1, wherein each connector optionally includes a cover which is hooked onto the guide elements of the surface of the connector.

7. The modular construction system according to claim 1, wherein a transversal area of the upper structure of the roof has a central gutter and raised quadrangular ends of different sizes so that one end fits into an end of the adjacent wall.

* * * * *